US005916048A

United States Patent [19]

Hurell et al.

[11] Patent Number: 5,916,048

[45] **Date of Patent: *Jun. 29, 1999**

[54] ILLUMINATED BASKETBALL GOAL AND BASKETBALL

[76] Inventors: Larry Hurell; Andre L. Edge, both of 1824 Mechanicsville Rd., Florence, S.C. 29501

[ * ] Notice: This patent is subject to a terminal disclaimer.

[21] Appl. No.: 08/959,793

[22] Filed: Oct. 29, 1997

Related U.S. Application Data

[63] Continuation-in-part of application No. 08/821,957, Feb. 4, 1997, Pat. No. 5,711,727.

[51] Int. Cl.[6] ..... A63B 63/08

[52] U.S. Cl. ..... 473/479; 273/DIG. 24; 473/481; 473/485; 473/570

[58] Field of Search ..... 473/479, 481, 473/447, 485, 570

[56] References Cited

U.S. PATENT DOCUMENTS

| | | | |
|---|---|---|---|
| D. 349,317 | 8/1994 | Offutt | D21/201 |
| 4,984,787 | 1/1991 | Nesbit et al. | 473/481 |
| 5,045,755 | 9/1991 | Appelberg | 313/498 |
| 5,124,899 | 6/1992 | Hale | 362/253 |
| 5,192,080 | 3/1993 | Duncan | 473/479 X |
| 5,305,998 | 4/1994 | Nesbit et al. | 473/481 |
| 5,346,207 | 9/1994 | Heinen | 473/481 |
| 5,375,103 | 12/1994 | Ullon | 368/12 |
| 5,403,000 | 4/1995 | Woolsey | 473/447 |
| 5,711,727 | 1/1998 | Edge et al. | 473/479 |

*Primary Examiner*—William H. Grieb
*Attorney, Agent, or Firm*—Michael A Mann; Nexsen Pruet Jacobs & Pollard LLP

[57] ABSTRACT

An illuminated basketball goal comprises a first light source carried by the perimeter of the backboard and a second light source positioned within a recess formed in the perimeter of the rim. The target square, located on the front face of the backboard is made of an electroluminescent material or a fluorescent compound which glows upon activation of the first and second light source. The net depending from the rim is made of a reflective material. The first and second light source are made of a luminous material, providing an even, indirect source of illumination. Also advanced is a basketball having a luminous coating placed within the ribs recessed below the surface of the ball. Alternatively, the ball can be formed with clear tubing which accepts a charge of a chemiluminescent fluid.

18 Claims, 3 Drawing Sheets

ILLUMINATED BASKETBALL GOAL AND BASKETBALL

This application is a continuation-in-part of application Ser. No. 08/821,957 filed on Feb. 4, 1997, now U.S. Pat. No. 5,711,727.

BACKGROUND OF THE INVENTION

1. Field of the Invention

The present invention relates generally to basketball goals. More specifically, the present invention provides an illuminated basketball backboard and rim.

2. Discussion of Background

The game of basketball is a well known and popular sport played by individuals of all ages and skill levels. Due to its appeal, many homeowners install a basketball goal adjacent to their driveway, and neighborhood recreational areas have basketball courts. A basketball goal normally includes a vertically disposed backboard and a rim (or hoop) extending therefrom into which a basketball is thrown. The goal is usually supported a distance above the ground on a pole. In other instances, the goal extends from, and is secured to, the end or side of a building, such as a garage.

Many individuals who own basketball goals attempt to play the game at night by the light of street lamps and the exterior lighting of homes. These lights rarely provide sufficient lighting for a number of reasons. First, outdoor lighting, such as street lighting or an outdoor spotlight, is usually not bright enough to fully illuminate the basketball goal. Second, it is usually not specifically positioned to illuminate the basketball goal in a way that will minimize shadows. Third, outdoor lighting systems produce a concentrated light that may make it harder to see a basketball rim when the light source is behind the backstop.

In response to the inadequacies of outdoor lighting systems, the prior art has generated several systems that attempt to illuminate the basketball goal and the area surrounding it. However, these systems usually employ lamps positioned within the backboard or placed a distance directly above the backboard. As with outdoor lighting systems, these basketball goal illumination systems use direct light which makes it difficult, and at times impossible, to see the basketball goal. Moreover, the strength and positioning of these lights result in one area of the backboard being lit while the rest of the backboard remains relatively dark.

Consequently, there exists a need for a basketball goal illumination system which evenly illuminates the backboard, rim, and surrounding area without the use of direct, white light.

SUMMARY OF THE INVENTION

According to its major aspects and briefly stated, the present invention is a basketball goal illumination system comprising a first light source secured about the perimeter of the backboard and a second light source positioned within a recess formed about the perimeter of the rim. Both the first and second light source are preferably made of an electroluminescent material. A transparent cover placed over the first light source prevents damage due, for example, to inclement weather. A target square located on the front of the backboard may also include electroluminescent material or may be painted with a fluorescent paint. The net depending from the rim is made of a light-reflective material. When activated by a source of electric power, the electroluminous material illuminates the backboard, including the target square, rim, and adjacent area. The emitted light also strikes fluorescent surfaces and the reflective net, thereby illuminating all the major components of the basketball goal.

The present invention may also be characterized as a system for playing basketball including a basketball goal illumination system, as discussed above, and an illuminated basketball. The basketball is illuminated by placing luminous material within the ribs of the basketball. The illuminated basketball may be accompanied by a chamber having in its interior at least one light source. When the luminous material begins to lose its strength, it is placed in the interior of the chamber and is recharged by activating the light source. Alternatively, the ball is fitted with fine tubing placed within the ribs of the ball. The interior of the tubing accepts a charge of chemiluminescent fluid. A valve, positioned within the tubing, allows the injection and removal of the chemiluminous material from the tubing.

A major feature of the present invention is the use of an electroluminous material to illuminate the backboard, target square and rim. The light given off by the luminous material results in an even distribution of light about the perimeter of the backboard, the rim, and surrounding area. Also, the light issued does not fatigue the eyes. Consequently, a player is capable of viewing the entirety of the backboard from any position on the court and can shoot the ball without being optically overwhelmed by direct lighting Another major feature of the present invention is the electroluminescent target square. Most backboards are constructed of a transparent polymer that allows the transmission of light therethrough. Thus, when the backboard and target square are illuminated, light diffuses through the backboard. As a result, players can see the target so that they can better aim their shots, as if under daylight conditions.

Still another feature of the present invention is the combination of an illuminated basketball goal in combination with an illuminated basketball. This combination enables individuals to play basketball at night and adds a dimension of visual appeal to the game.

Other features and advantages will be apparent to those skilled in the art from a careful reading of the Detailed Description of a Preferred Embodiment accompanied by the following drawings.

DETAILED DESCRIPTION OF PREFERRED EMBODIMENTS

Figure 1:
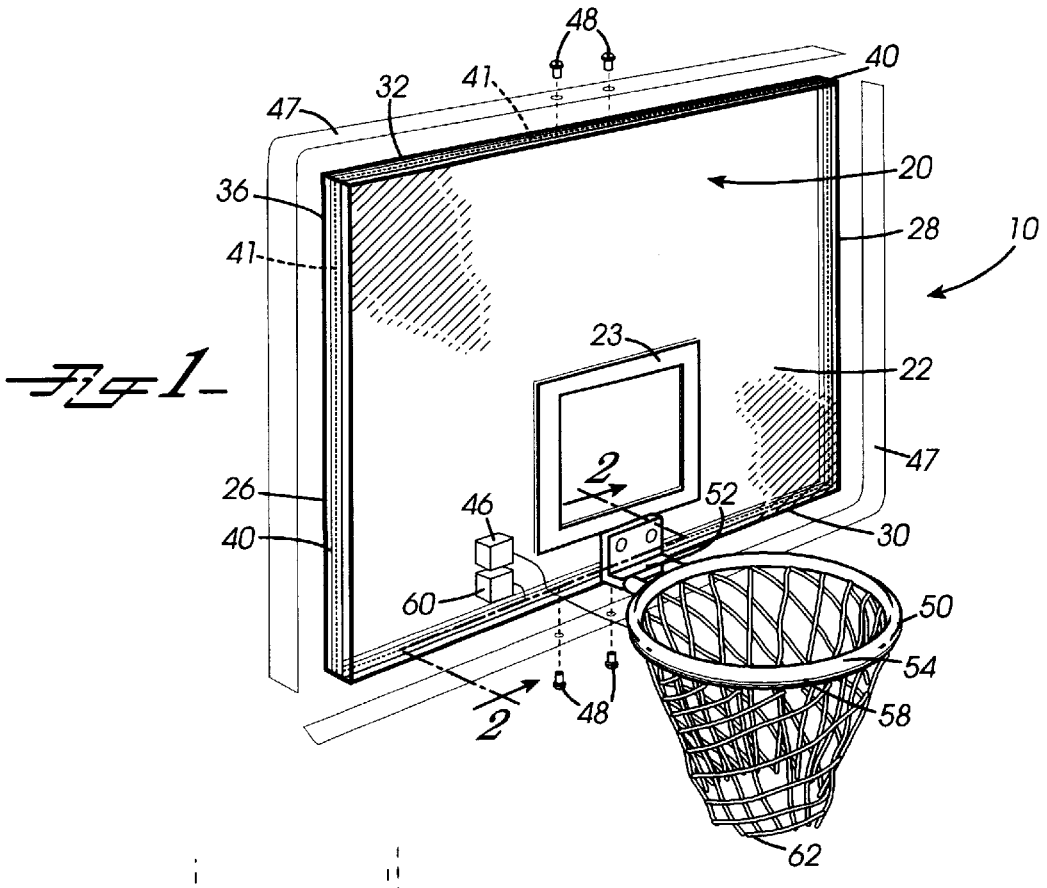
FIG. 1 is a perspective, partially exploded view of an illuminated basketball goal according to a preferred embodiment of the present invention.
Figure 2:
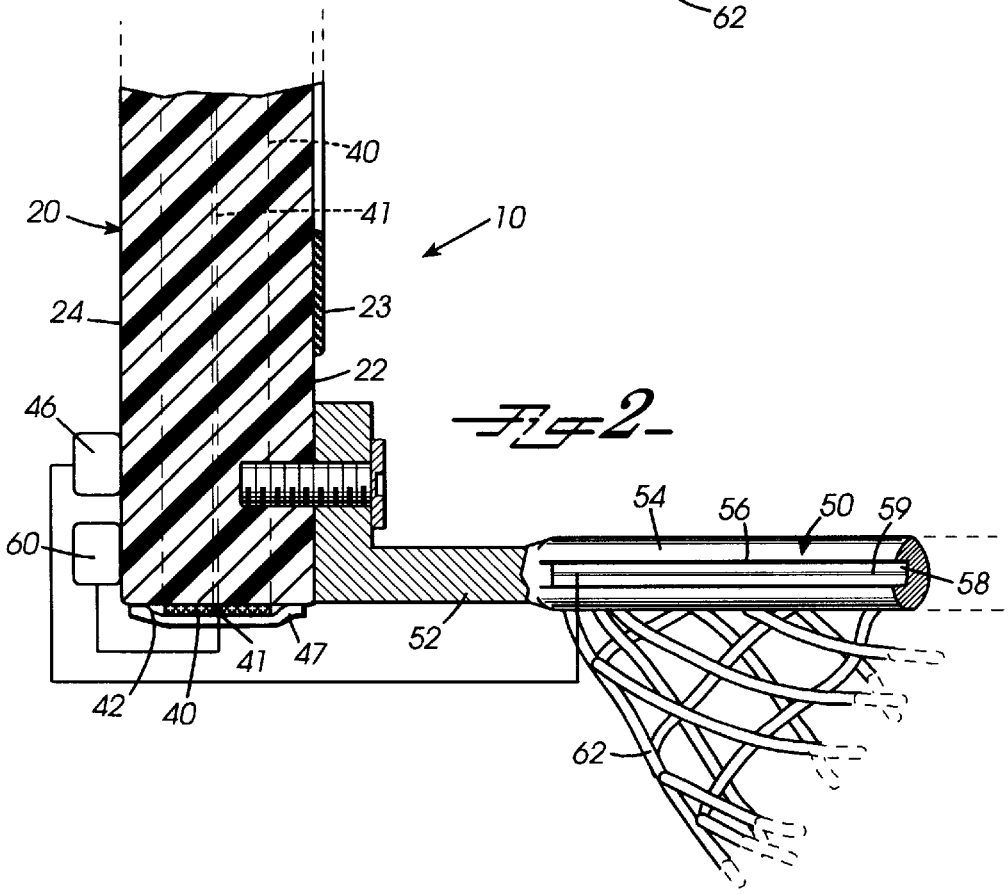
FIG. 2 is detailed, cross-sectional side view of an illuminated basketball goal according to a preferred embodiment of the present invention taken along line 2'2 of FIG. 1.
Figure 6:
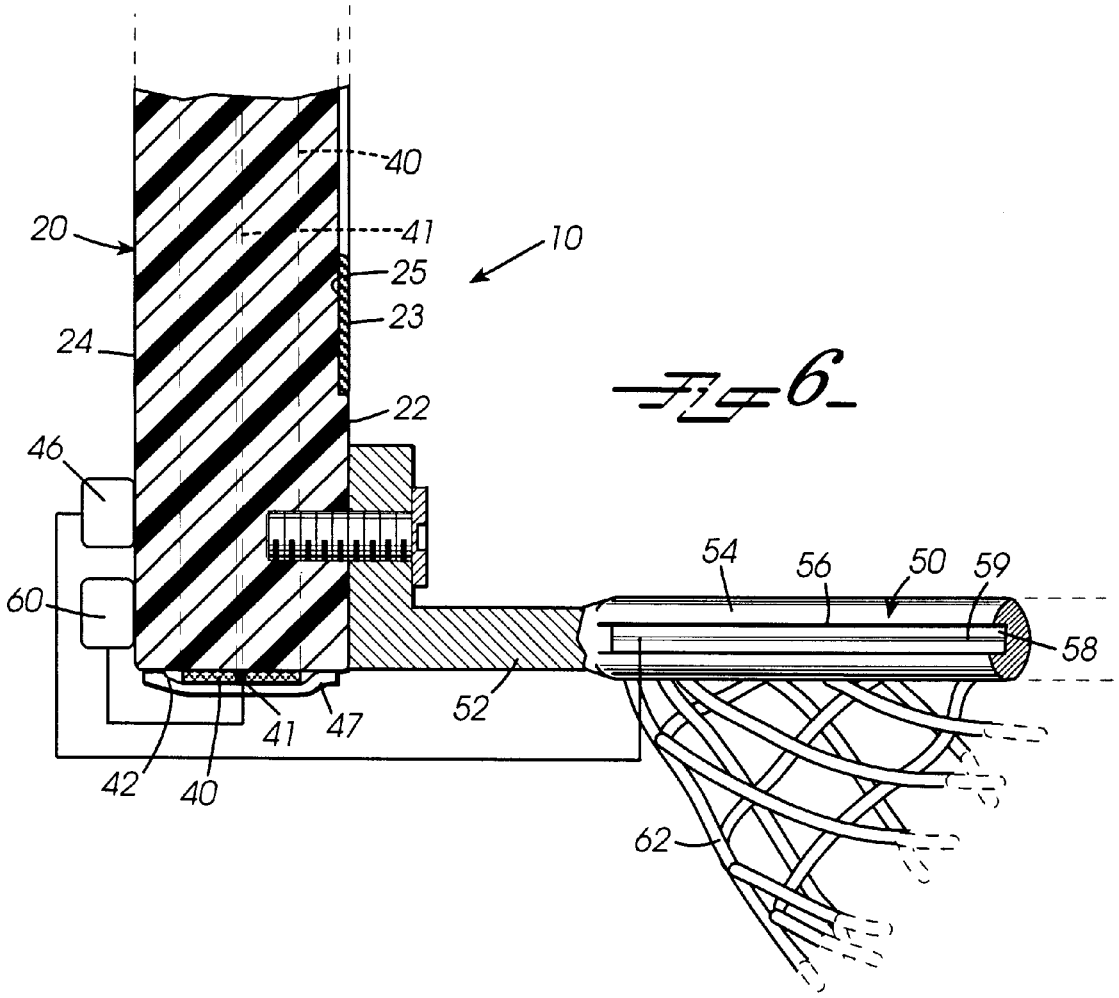
FIG. 6 is an alternative view of a basketball backboard according to a preferred embodiment of the present invention.

The present invention is an illuminated basketball goal. The present invention is also a system for use in playing basketball in dim light. Turning now to FIGS. 1, 2 and 6, there is shown a perspective view, a detailed cross-sectional side view and a detailed cross-sectional view of an alternative embodiment, respectively, of an illuminated basketball goal, according to the preferred embodiments of the invention and generally designated by reference numeral 10.

Goal 10 comprises a backboard 20 and rim 50, extending from backboard 20 and secured thereto by a support member 52. Backboard 20 comprises a front face 22, a rear face 24, opposing sides 26 and 28, and opposing ends 30 and 32. Opposing ends 30 and 32 and opposing sides 26 and 28 collectively form perimeter 36. Preferably, backboard 20 is made of a light transmissive substance, as illustrated in FIGS. 1 and 2, but may in one embodiment of the present invention be made of an opaque substance, as illustrated in FIG. 6. It is recognized that although illustrated as having a rectangular shape, backboard 20 may assume any shape without deviating from the spirit and scope of the present invention. Rim 50 is normally circular in shape and manufactured of a metal, metal alloy, or composite material.

Removably secured about perimeter 36 of backboard 20 is a light source 40 powered by a power source 46. Power source 46 is preferably carried by rear face 24 of backboard 20. Light source 40 is preferably an electroluminescent light source having a first and second conductor separated by an electroluminous substance having a conductive strip 41 embedded therein. Strip 41 derives electricity from power source 46 so that upon activation of power source 46, an electric current is conducted through strip 41 which, in turn, causes the illumination of light source 40. Light source 40 is preferably secured to perimeter 36 by an adhesive material carried by surface 42 of light source 40. An example of an electroluminescent light source 40 capable of use with the present invention is the subject of U.S. Pat. No. 5,045,755, which is incorporated herein by reference and sold under the trademark CALIFORNEON. This material is thin and flexible; furthermore, it can operate on a few volts DC and will remain luminous for several years between replacements. Other thin, flexible electroluminescent light source materials are also available. A cover 47 is placed over light source 40 to prevent damage due to inclement weather. Cover 47 can be made from a variety of materials and may come in a variety of colors. Cover 47 is secured to perimeter 36 of backboard 20 by bolts 48, or any other convenient fastening means.

A light source 58 is carried by exterior perimeter 54 of rim 50. Light source 58 is powered by a power source 60. Preferably, light source 58 is positioned within a recess 56 formed within exterior perimeter 54 of rim 50 to prevent damage due to contact with a basketball or the hands of a player grasping rim 50. Light source 58 is also preferably an electroluminescent material having a conductive strip 59 embedded therein, and secured to rim 50 by the use of an adhesive. As with light source 40, light source 58 illuminates when strip 59 receives an electric current from power source 60.

Power sources 4 6 and 60 can be any AC, DC, or solar powered source capable of generating a voltage sufficient to illuminate light sources 40 and 58. In addition, it is recognized that power sources 46 and 60 can be equipped with circuitry commonly employed in the art, which allows a pulsed voltage to be sent to light sources 40 and 58, respectively. This pulsed voltage will cause light sources 40 and 58 to flash. Preferably, this circuitry would be activated by a sensor (not shown) carried near rim 50 and activated by a basketball passing through the rim to indicate a score. Alternatively, the sensor can be a switch triggered or closed by the ball passing through the rim.

Located on front face 22 of backboard 20 is a target square 23. Preferably, target square 23 is made of a fluorescent material which is painted on or adhered to front face 22, as shown in FIGS. 1 and 2, or target square 23 may be made of the same electroluminescent material surrounding backboard 20 and fitted in a shallow recess 25, as illustrated in FIG. 6. Depending from rim 50 is a net 62. Net 62 is made of a reflective material, such as reflective nylon, or alternatively, net 62 is made of a fluorescent material. When target square 23 is made of an electroluminescent material, backboard 20 may be made of an opaque material since light from perimeter 36 does not have to be transmitted through backboard 20 to a fluorescent square 23.

In operation, perimeter 36 of backboard 20 is polished prior to placement of light source 40 to optimize the transmission of light into backboard 20. Thereafter, light source 40 is secured to perimeter 36 and light source 58 is attached to perimeter 54 of rim 50. Protective cover 47 is then placed over perimeter 36 and secured to backboard 20 using bolts 48. Light sources 40 and 58 can easily be removed from perimeter 36 and rim 50, respectively, if they need to be replaced. Perimeter 36 and rim 50 are then cleaned to remove any residual adhesive. Thereafter, replacement light sources 40 and 58 are placed on backboard 20 and rim 50.

Figure 3:
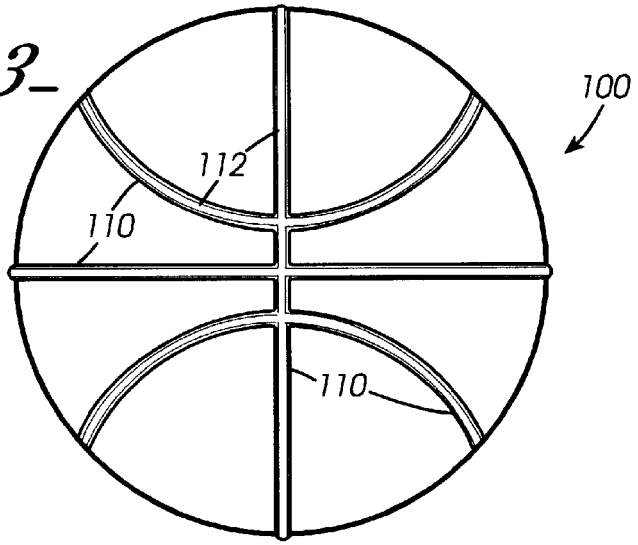
FIG. 3 is a front view of an illuminated basketball according to a preferred embodiment of the present invention.

Turning now to FIG. 3, there is shown an illuminated basketball according to a preferred embodiment of the present invention and generally designated by reference numeral 100. Basketball 100 is formed with a plurality of ribs 110 having a luminous material 112 contained therein. Preferably luminous material 112 is a phosphorescent material and can be applied as a coating or an adhesive strip.

Figure 4:
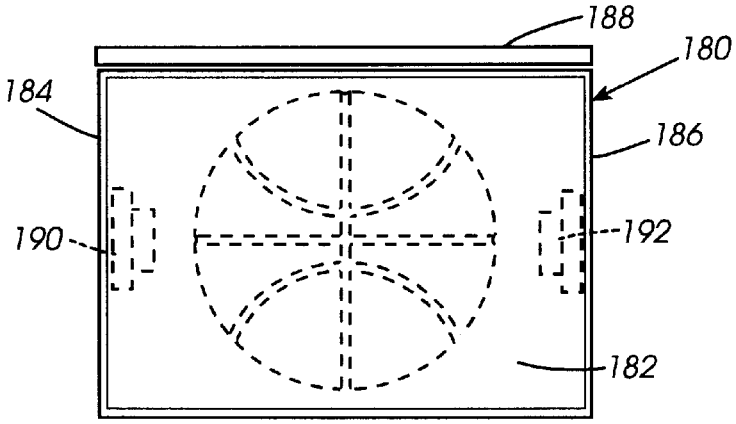
FIG. 4 is a side view of a chamber for recharging an illuminated basketball, with the basketball and light sources illustrated in ghost, according to an alternative preferred embodiment of the present invention.

Turning now to FIG. 4, there is shown a side view of a chamber 180 for use in recharging luminous material 112 of basketball 100. Chamber 180 comprises an interior 182 dimensioned to accept a basketball 100, opposing sides 184 and 186, and a rotatable top 188. Positioned within interior 182 and supported by sides 184 and 186 are a pair of lights 190 and 192. Lights 190 and 192, when energized, emit radiation which is absorbed by luminous material 112. Preferably, lights 190 and 192 are black lights. As used herein, the phrase "black light" means a light source which emits ultraviolet radiation. To recharge luminous material 112, top 188 is opened and basketball 100 placed within interior 182. After closing top 188, lights 190 and 192 are activated. When recharging is complete, lights 190 and 192 are deactivated and basketball 100 is removed from chamber 180.

Figure 5:
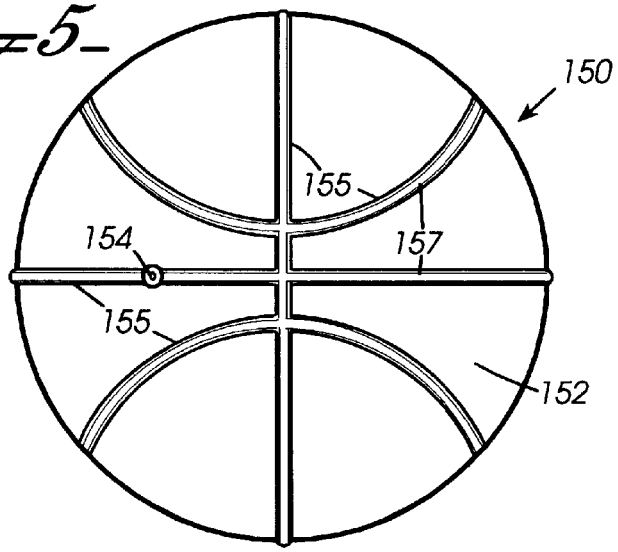
FIG. 5 is a front view of an illuminated basketball according to alternative preferred embodiment of the present invention.

Reference is now made to FIG. 5, which shows an illuminated basketball according to an alternative preferred embodiment of the present invention and generally designated by reference numeral 150. Basketball 150 is formed with clear tubing 155. Surface 152 of basketball 150 carries tubing 155 which includes a valve 154. Valve 154 is opened to receive a charge of luminous fluid 157. Preferably, luminous fluid 157 is a chemiluminescent fluid. Valve 154 also enables the extraction of luminous fluid 157 from tubing 155. Subsequent to extraction, a replacement charge of luminous fluid 157 may be injected into tubing 155. Injection and extraction of luminous fluid 157 can be accomplished by using a pump (not shown) equipped with a needle dimensioned to fit valve 154.

It will be apparent to those skilled in the art that many modifications and substitutions can be made to the preferred embodiment just described without departing from the spirit and scope of the invention as defined in the appended claims.

What is claimed is:

1. A basketball goal comprising:

a backboard, said backboard having a perimeter and a front surface;

a rim extending from said front surface of said backboard, said rim having a perimeter;

means for illuminating said backboard, said backboard illuminating means carried by said perimeter of said backboard;

a target square placed on said backboard, said target square being made of an electroluminescent material; and means for illuminating said rim, said rim illuminating means carried by said perimeter of said rim.

2. The goal as recited in claim 1, wherein said rim is formed with a recess about said perimeter and said rim illuminating means is positioned within said recess.

3. The goal as recited in claim 1, further comprising a removable cover, said cover made of a transparent material, said cover positioned about said perimeter of said backboard, said cover positioned over said backboard illuminating means.

4. The goal as recited in claim 1, wherein said backboard illuminating means further comprises:

an electroluminescent material, a conductive strip embedded in said electroluminescent material, and a power source, said power source in electrical connection with said conductive strip so that said electroluminescent material illuminates when said power source is activated.

5. The goal as recited in claim 1, wherein said rim illuminating means further comprises:

an electroluminescent material, a conductive strip embedded in said electroluminescent material, and a power source, said power source in electrical connection with said conductive strip so that said electroluminescent material illuminates when said power source is activated.

6. The goal as recited in claim 1, further comprising a net depending from said rim, said net being made of a reflective material.

7. A basketball goal comprising:

a backboard, said backboard having a perimeter and a front surface;

a rim extending from said front surface of said backboard, said rim having a perimeter, said rim having a recess formed about said perimeter;

a target square positioned on said front face of said rim;

means for illuminating said backboard, said backboard illuminating means carried by said perimeter of said backboard;

means for illuminating said rim, said rim illuminating means positioned within said recess of said rim; and said target square made of an electroluminescent material, said target square carried by said backboard.

8. The goal as recited in claim 7, further comprising a removable cover, said cover made of a transparent material, said cover positioned about said perimeter of said backboard, said cover positioned over said backboard illuminating means.

9. The goal as recited in claim 7, wherein said backboard illuminating means further comprises:

an electroluminescent material, a conductive strip embedded in said electroluminescent material; and a power source, said power source in electrical connection with said conductive strip so that said electroluminescent material illuminates when said power source is activated.

10. The goal as recited in claim 7, wherein said rim illuminating means further comprises:

an electroluminescent material, a conductive strip embedded in said electroluminescent material; and a power source, said power source in electrical connection with said conductive strip so that said electroluminescent material illuminates when said power source is activated.

11. The goal as recited in claim 7, further comprising a net depending from said rim, said net being made of a reflective material.

12. A system for playing basketball comprising:

a backboard, said backboard having a perimeter and a front surface;

a rim extending from said front surface of said backboard, said rim having a perimeter;

means for illuminating said backboard, said backboard illuminating means carried by said perimeter of said backboard;

means for illuminating said rim, said rim illuminating means carried by said perimeter of said rim;

a basketball having an exterior, said basketball having a plurality of ribs on said exterior;

a target square carried by said backboard and made of an electroluminescent material; and means for illuminating said basketball.

13. The system as recited in claim 12, wherein said basketball illuminating means further comprises:

tubing positioned in said ribs of said basketball, said tubing having a valve; and a luminous fluid carried in said tubing.

14. The system as recited in claim 12, wherein said basketball illuminating means further comprises:

a luminous coating placed in said ribs of said basketball; and a chamber comprising an interior dimensioned to receive said basketball, a removable top, and at least one light source carried by said interior of said chamber.

15. The system as recited in claim 12, wherein said rim is formed with a recess about said perimeter and said rim illuminating means is positioned within said recess.

16. The system as recited in claim 12, wherein said backboard illuminating means further comprises:

an electroluminescent material, a conductive strip embedded in said electroluminescent material, and a power source, said power source in electrical connection with said conductive strip so that said electroluminescent material illuminates when said power source is activated.

17. The system as recited in claim 12, wherein said rim illuminating means further comprises:

an electroluminescent material, a conductive strip embedded in said electroluminescent material, and a power source, said power source in electrical connection with said conductive strip so that said electroluminescent material illuminates when said power source is activated.

18. The system as recited in claim 12, further comprising a net depending from said rim, said net being made of a reflective material.

* * * * *